United States Patent [19]

Wilson

[11] Patent Number: 4,781,229

[45] Date of Patent: Nov. 1, 1988

[54] SPINDLELESS VENEER LATHE

[75] Inventor: Gary L. Wilson, Richmond, Canada

[73] Assignee: Durand-Raute Industries Ltd., British Columbia, Canada

[21] Appl. No.: 158,293

[22] Filed: Feb. 19, 1988

Related U.S. Application Data

[63] Continuation-in-part of Ser. No. 947,400, Dec. 29, 1986, abandoned.

[30] Foreign Application Priority Data

Sep. 24, 1986 [CA] Canada ..... 519035

[51] Int. Cl.[4] ..... B27L 5/02

[52] U.S. Cl. ..... 144/213; 144/209 R; 144/357; 144/365; 364/474.02

[58] Field of Search ..... 144/209 R, 213, 365, 144/357; 364/475

[56] References Cited

U.S. PATENT DOCUMENTS

| | | | |
|---|---|---|---|
| 1,745,890 | 2/1930 | Dike et al. . | |
| 1,951,834 | 3/1934 | McCassoll . | |
| 3,136,095 | 9/1964 | Silven et al. | 144/209 UX |
| 3,244,206 | 4/1966 | Bossen . | |
| 4,073,326 | 2/1978 | Pank et al. . | |
| 4,287,462 | 9/1981 | Beck et al. . | |
| 4,335,764 | 6/1982 | Schmidt . | |
| 4,381,023 | 4/1983 | Fronczak et al. | 144/209 R |
| 4,454,900 | 6/1984 | Hayes . | |
| 4,494,588 | 1/1985 | Berry et al. . | |
| 4,494,590 | 1/1985 | Kajikawa et al. . | |
| 4,499,935 | 2/1985 | Hasegawa et al. . | |
| 4,506,714 | 3/1985 | Shrum et al. . | |
| 4,554,958 | 11/1985 | Schmidt | 144/365 |
| 4,557,304 | 10/1985 | Shrum | 144/213 |

FOREIGN PATENT DOCUMENTS

| | | |
|---|---|---|
| 0056301 | 7/1982 | European Pat. Off. . |
| 470554 | 1/1929 | Fed. Rep. of Germany . |
| 1210976 | 10/1964 | Fed. Rep. of Germany . |
| 821149 | 4/1981 | U.S.S.R. . |

*Primary Examiner*—W. Donald Bray
*Attorney, Agent, or Firm*—Chernoff, Vilhauer, McClung & Stenzel

[57] ABSTRACT

A veneer lathe having a fixed roller, a slidably positionable pressure roller and a slidably positionable following roller. A following roller positioning means selectably positions the following roller with respect to the fixed and pressure rollers in response to a following roller position control signal. The rollers are rotated against a block positioned between the rollers, thereby rotating the block with respect to a knife, which peels veneer from the block. The pressure roller is slidably positionable in a first plane, and the following roller is slidably positionable into a selected location in a second plane, thereby affording precise control over peeling of the block.

A knife positioning means controllably advances the knife into the rotating block in response to a knife position control signal. A knife angling means controllably positions the knife at a selectably variable angle with respect to the rotating block in response to a knife angle control signal. Pressure and following roller position sensing means sense the positions of the pressure and following rollers respectively and produce pressure and following roller position output signals representative thereof. A signal processing means (i.e. a computer) receives the output signals and produces the following roller position control signal, the knife position control signal and the knife angle control signal as functions of the output signals.

21 Claims, 4 Drawing Sheets

SPINDLELESS VENEER LATHE

REFERENCE TO RELATED APPLICATION

This application is a continuation-in-part of U.S. application Ser. No. 06/947,400 filed 29 Dec., 1986 now abandoned.

FIELD OF THE INVENTION

This application pertains to a spindleless or centerless veneer lathe for peeling veneer from a log or "block" (in the art, peel logs are known as "blocks"), without requiring the block to be driven and supported at its ends. More particularly, the application pertains to a spindleless veneer lathe in which the block is rotated between three rollers, at least one of which may be independently positioned, thereby enabling precise control of the peeling operation.

BACKGROUND OF THE INVENTION

The prior art is exemplified by U.S. Pat. No. 4,335,764 issued 22 June, 1982 for an invention of Charles J. Schmidt entitled "Veneer Peeling Apparatus". Schmidt provides a spindleless or centerless veneer peeling lathe having a fixed roller and two movable rollers. A block to be peeled is positioned between the rollers, which are rotatably driven against the block, thereby rotating the block. As the block rotates, the movable rollers are moved towards the fixed roller, thus forcing the block into a knife mounted near the fixed roller, which peels veneer from the rotating block.

In Schmidt's apparatus, the two movable rollers are positioned at equal distances from the fixed roller at all times. This is achieved with the aid of a timing means, such as a pair of gears, which mechanically couple the movable rollers to each other and prevent movement of one roller without equal movement of the other. Such mechanical coupling of the movable rollers constitutes a significant practical disadvantage, because it does not permit precise control of the geometric relationship between the block and the knife during peeling of the block, due to the inability to move one of the movable rollers without a corresponding equal movement of the other movable roller. Such precise control is often desired in particular cases to ensure production of high quality veneer of uniform thickness. The type and condition of the wood which is to be peeled may for example necessitate continuous variation of the geometric relationship between the block and the knife during peeling of the block in order to achieve optimal results.

A further disadvantage of Schmidt's apparatus is that the movable rollers are mounted on support beams which must be swung, relatively rapidly, through curved paths as the block is peeled. The support beams have a high rotational inertia. Thus, high power input is required to move the beams. Moreover, control problems are encountered, due to the susceptibility of the swinging beams to harmonic oscillations as they swing through their working arcs.

The present invention overcomes the disadvantages aforesaid by mounting the movable rollers such that at least one of them may be selectably positioned with respect to the other two rollers in response to a control signal generated by a computer, thereby facilitating control of the geometric relationship between the block and the knife.

A still further disadvantage of Schmidt's apparatus is that the two movable rollers rotate at the same speed (disregarding minor speed variations which are introduced as the gear drive is actuated to swing the rotatably driven rolls through their curved working paths). Although Schmidt provides for a difference of about one percent in the speed of the fixed roller, in comparison to the speed of the movable rollers, there is no provision for varying the rotational speed of each roller independently of the rotational speed of the other rollers. Roller speed variation is advantageous because it enables the rollers to accurately follow the surface of the rotating block, without skidding against the block surface and wasting power or interfering with the peeling operation. Because the block is peeled in a spiral, the rollers must each rotate at slightly different speeds which vary continuously as peeling proceeds. Variable control of the speed of each roller, which is a feature of the present invention, also facilitates ejection of the peeled block core from the lathe when the peeling operation is completed, and loading of a fresh block into the lathe.

SUMMARY OF THE INVENTION

The invention provides a veneer lathe, comprising a fixed roller, a pressure roller and a following roller. A pressure roller support slidably carries the pressure roller. Means are provided for moving the pressure roller along the pressure roller support relative to a block positioned between the rollers. A following roller support slidably carries the following roller. Means are also provided for moving the following roller along the following roller support relative to the block. A following roller positioning means selectively positions the following roller with respect to the fixed and pressure rollers in response to a following roller position control signal. Rotation of the rollers against the block rotates the block with respect to a knife, which peels veneer from the block.

The pressure roller is slidably positionable in a first plane, and the following roller is slidably positionable into a selected location in a second plane, thereby facilitating precise, continuous control of the angle between the block and the knife.

A pressure roller position sensing means senses the position of the pressure roller and produces a pressure roller position output signal representative thereof. A following roller position sensing means senses the position of the following roller and produces a following roller position output signal representative thereof. A signal processing means receives the two output signals and produces the following roller position control signal as a function of the output signals.

A fixed roller drive means rotatably drives the fixed roller, a pressure roller drive means rotatably drives the pressure roller, and a following roller drive means rotatably drives the following roller. Accordingly, the fixed roller may be rotated at a first speed while the pressure roller is rotated at a second speed and while the following roller is rotated at a third speed.

Preferably, a knife angling means controllably positions the knife at a selectably variable angle with respect to the rotating block in response to a knife angle control signal. Advantageously, a knife positioning means may controllably advance the knife into the rotating block in response to a knife position control signal. The signal processing means produces the knife position control signal and the knife angle control signal as functions of the pressure roller position output signal Advantageously, the signal processing means may also receive one or more user-supplied parameters representative of a desired operating condition of the veneer lathe and then alter the following roller position control signal, the knife position control signal, and/or the knife angle control signal in response thereto to cause the veneer lathe to assume the desired operating condition.

BRIEF DESCRIPTION OF THE DRAWINGS

In FIG. 1, portions of the lathe are shown in hidden detail.

In FIG. 3, the central portion of the lathe has been removed in order to show both of the opposed ends of the lathe.

DETAILED DESCRIPTION OF THE PREFERRED EMBODIMENT

Figure 1:
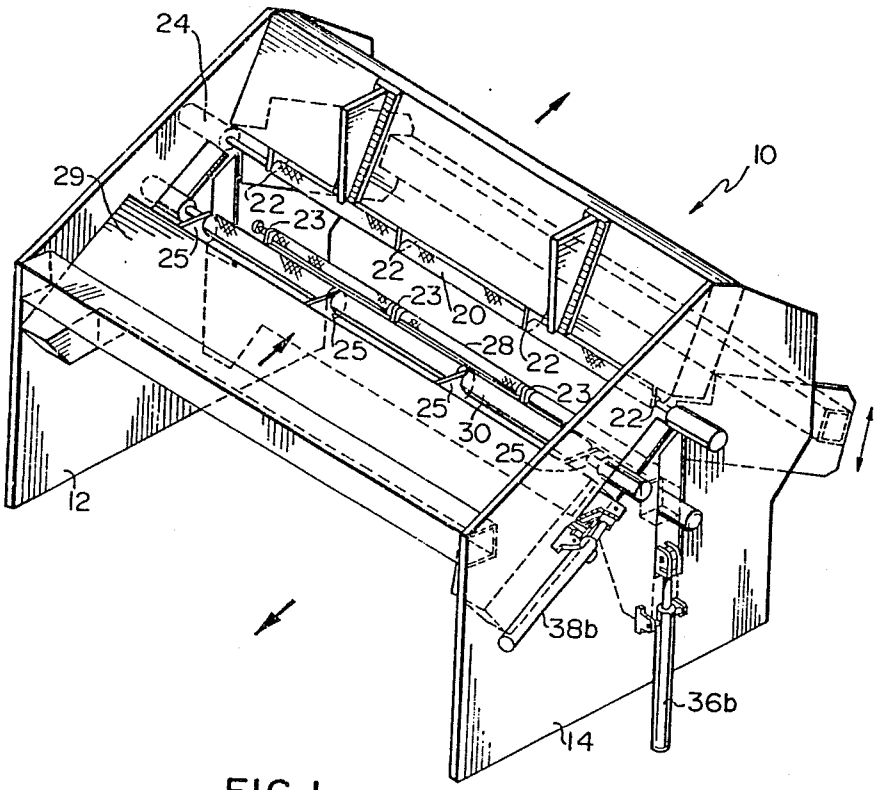
FIG. 1 is a pictorial illustration of a spindleless veneer lathe in accordance with the preferred embodiment.
Figure 2:
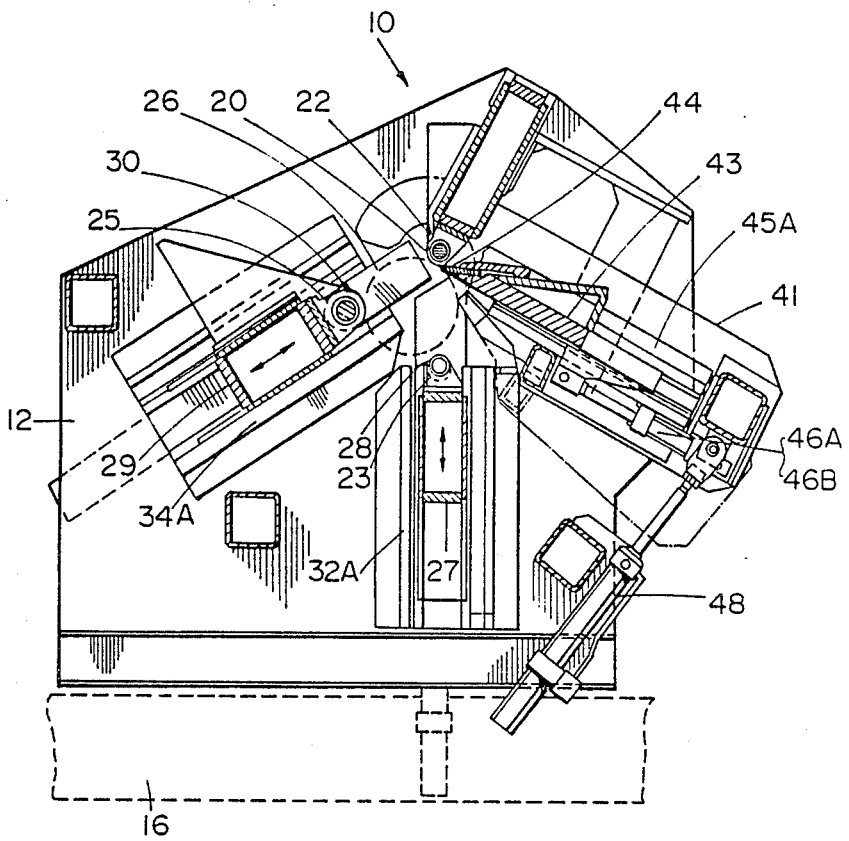
FIG. 2 is a cross-sectional side elevation view of the lathe of FIG. 1.
Figure 3:
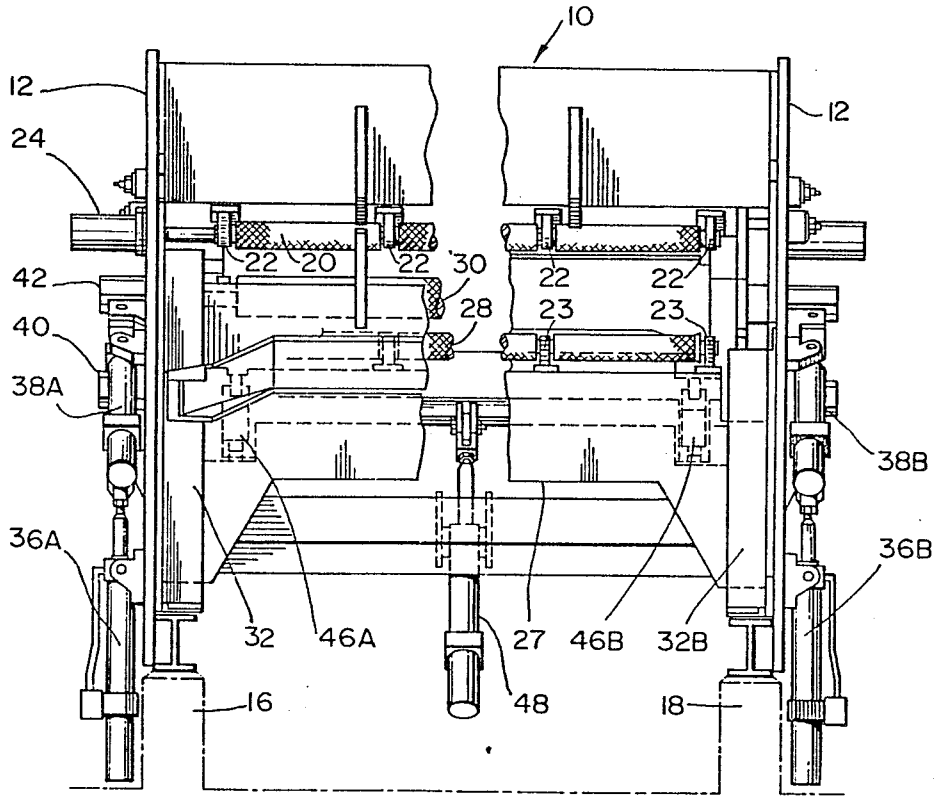
FIG. 3 is a front elevation view of the lathe of FIG. 1.
Figure 4:
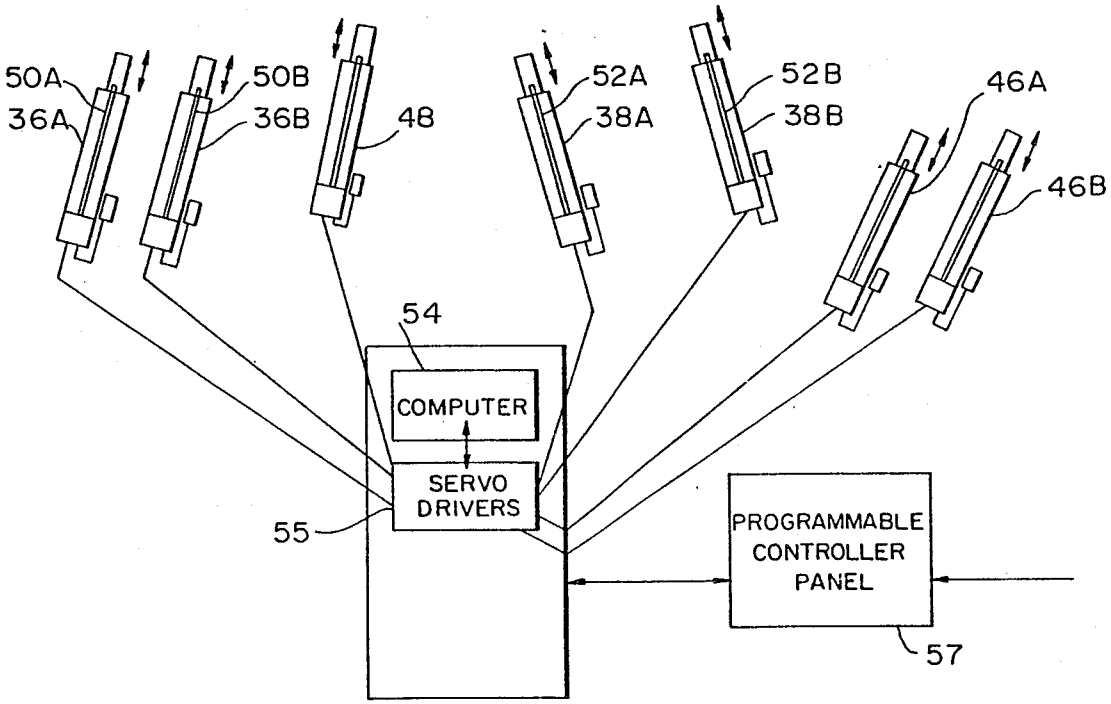
FIG. 4 is a simplified schematic diagram of the control system of the preferred embodiment.

The drawings illustrate a spindleless veneer lathe, generally designated 10, comprising a pair of opposed side frame members 12, 14 mounted upon supports 16, 18. Fixed roller 20 rotatably supported by bearings 22 is fixed in position between frame members 12, 14 for rotational driving by a "fixed roller drive means"; namely, hydraulic motor 24, against the upper surface of block 26 (FIG. 2). Following roller 28 is rotatably supported by bearings 23 on the end of following roller support beam 27. The opposed ends of following roller support beam 27 are slidably carried by a "following roller support"; namely, channel members 32*a*, 32*b* which are rigidly affixed to the opposed inner surfaces of frame members 12, 14 respectively, such that slidable movement of following roller support beam 27 within channel members 32*a*, 32*b* causes following roller 28 to slide back and forth relative to block 26 within a first plane defined by the orientation of channel members 32*a*, 32*b*. A pair of hydraulically driven cylinders 36*a*, 36*b* coupled between the frame of veneer lathe 10 and the ends of following roller support beam 27 may be controllably actuated to extend or retract in response to a following roller position control signal (the production of which is hereinafter explained). Following roller support beam 27, opposed channel members 32*a*, 32*b* and hydraulic cylinders 36*a*, 36*b* together constitute a "following roller positioning means" for selectable positioning of following roller 28 with respect to fixed roller 20 by controllable actuation of cylinders 36*a*, 36*b* to extend or retract and thus slide following roller support beam 27 and, with it, following roller 28 into a selected location in the first plane aforesaid.

Pressure roller 30 is similarly rotatably supported by bearings 25 on the end of pressure roller support beam 29. The opposed ends of pressure roller support beam 29 are slidably carried by a "pressure roller support"; namely, channel members 34*a*, 34*b* which are rigidly affixed to the opposed inner surfaces of frame members 12, 14 respectively, such that slidable movement of pressure roller support beam 29 within channel members 34*a*, 34*b* causes pressure roller 30 to slide back and forth relative to block 26 within a second plane defined by the orientation of channel members 34*a*, 34*b*. A pair of hydraulically driven cylinders 38*a*, 38*b* coupled between the frame of veneer lathe 10 and the ends of pressure roller support beam 29 may be controllably actuated to extend or retract in response to a suitable control signal. Pressure roller support beam 29, opposed channel members 34*a*, 34*b* and hydraulic cylinders 38*a*, 38*b* together constitute a "pressure roller positioning means" for selectable positioning of pressure roller 30 with respect to fixed roller 20 by controllable actuation of cylinders 38*a*, 38*b* to extend or retract and thus slide pressure roller support beam 29 and, with it, pressure roller 30 within the second plane aforesaid. An important feature of the invention is that this arrangement permits following roller 28 to be positioned at any desired location in the first plane aforesaid, independently of the position of pressure roller 30.

A "following roller drive means"; namely, hydraulic motor 40, is provided for rotatably driving following roller 28 against the surface of block 26. A "pressure roller drive means"; namely, hydraulic motor 42, is provided for rotatably driving pressure roller 30 against the surface of block 26. Separate hydraulic circuits are used to drive each of motors 24, 40 and 42. Accordingly, fixed roller 20 may be driven at a first speed while following roller 28 is driven at a second speed and while pressure roller 30 is driven at a third speed. Such variable speed control is advantageous because the rotational speed of the block varies at different points around its circumference, since the block is peeled in a spiral, not in a true circle. Thus, each roller is preferably allowed to seek its own rotational equilibrium speed against the driven block, in order to prevent "skidding" of the rollers against the block, as happens when the rotational speed of the block varies with respect to that of any of the rollers.

A knife 44 is provided adjacent fixed roller 20 for peeling veneer from block 26 as cylinders 36*a*, 36*b*, 38*a* and 38*b* are controllably actuated to force the rotating pressure and following rollers 28, 30; and with them, block 26, toward fixed roller 20 and knife 44. Knife 44 is fixed on the end of knife support beam 43, the opposed ends of which are slidably mounted in a pair of channel members, only one of which, numbered 45*a*, is visible in the drawings. The knife support beam channel members are in turn rigidly affixed to a knife carriage 41. Knife carriage 41 is pivotally mounted between the opposed inner surfaces of frame members 12, 14. Slidable movement of knife support beam 43 within the channel members extends or retracts knife 44 with respect to block 26. This is accomplished via hydraulic cylinders 46*a*, 46*b* which are coupled between knife carriage 41 and knife support beam 43, such that controllable actuation of cylinders 46*a*, 46*b* in response to a knife position control signal extends or retracts knife support beam 43 and, with it, knife 44, within the channel members. Knife support beam 43, the associated channel members and hydraulic cylinders 46*a*, 46*b* thus constitute a "knife positioning means" for controllably advancing knife 44 into the rotating block in response to the knife position control signal.

The radius of curvature of block 26 continually decreases as block 26 is peeled. Accordingly, if knife 44 is held in a fixed position, as is common in the art, the angle between knife 44 and block 26 continually varies as the block is peeled. The angle between knife 44 and block 26 is preferably controlled to maintain a constant selected "knife rub" (i.e. that portion of the blade surface of knife 44 which is contacted by the veneer as it is peeled from block 26), in order to ensure that veneer of uniform thickness is peeled from the block. In the preferred embodiment, a "knife angling means"; namely, hydraulic cylinder 48 connected between the support base of veneer lathe 10 and knife carriage 41, is provided for controllably positioning knife 44, in response to a knife angle control signal, at a selectably variable angle with respect to the rotating block. More particularly, controllable actuation of cylinder 48 causes knife carriage 41 to pivot between the positions shown in solid and dotted outline in FIG. 2, thus facilitating control of the angle between knife 44 and block 26 to ensure that veneer of uniform thickness is peeled from the block. In the absence of comparable knife angling means, the veneer thickness may vary and the veneer may become ragged as the angle between the knife and the block varies during the peeling operation.

A "first roller position sensing means"; namely, linear encoders 50*a* and 50*b*, is provided on cylinders 36*a* and 36*b* respectively to sense the position of each cylinder, and thus the position of following roller 28, and to produce a following roller position output signal representative thereof. A "second roller position sensing means"; namely, linear encoders 52*a* and 52*b*, is provided on cylinders 38*a* and 38*b* respectively to sense the position of each cylinder, and thus the position of pressure roller 30, and to produce a pressure roller position output signal representative thereof. The two position output signals are received by a "signal processing means"; namely, microcomputer 54, which produces the following roller position control signal aforesaid via servo drivers 55 as a function of the two output signals, thereby maintaining block 26 and rollers 28, 30 in the preferred orientation for optimal peeling of veneer from block 26. Cylinders 46*a*, 46*b*, 48*a* and 48*b* are similarly provided with linear encoders (not shown) which produce output signals received by microcomputer 54 and which are representative, respectively, of the position and angle of knife 44 relative to block 26, thereby facilitating continuously variable control of the knife position and knife angle via production of the control signals aforesaid.

A number of user-supplied parameters representative of one or more desired operating conditions of lathe 10, such as the angle of knife 44 with respect to block 26, may be input to microcomputer 54 via control panel 57 in order to cause microcomputer 54 to alter the following roller position control signal, the knife position control signal and/or the knife angle control signal and cause lathe 10 to assume the desired operating condition.

In operation, microcomputer 54 produces suitable control signals to retract cylinders 36*a*, 36*b*, 38*a*, 38*b*, 46*a* and 46*b*; thus slidably withdrawing following and pressure rollers 28, 30 and knife 44 from fixed roller 20. When the three rollers are sufficiently far apart from each other, a fresh block is loaded into position in known fashion on top of the rotating pressure and following rollers, such that the block is rotatably supported on the pressure and following rollers. Microcomputer 54 then produces suitable control signals to extend cylinders 38*a* and 38*b*, thus slidably advancing pressure roller 30 and block 26 toward fixed roller 20. As pressure roller 30 advances, microcomputer 54 continually monitors its position, and that of following roller 28, via the pressure and following roller position output signals produced by encoders 50*a*, 50*b*, 52*a* and 52*b* and generates suitable following roller position control signals to cause following roller 28 to track the position of pressure roller 30 as it slidably advances toward fixed roller 20. That is, a selected differential is maintained between the distance from pressure roller 30 to fixed roller 20 on the one hand, and the distance from following roller 28 to fixed roller 20 on the other. In some cases pressure roller 30 may lead following roller 28, in the sense that the distance from pressure roller 30 to fixed roller 20 is maintained less than the distance from following roller 28 to fixed roller 20; whereas, in other cases, following roller 28 may lead pressure roller 30, in the sense that the distance from following roller 28 to fixed roller 20 is maintained less than the distance from pressure roller 30 to fixed roller 20. When block 26 contacts fixed roller 20 the three rollers drivingly rotate the block against knife 44, which peels veneer from the block. As peeling proceeds, microcomputer 54 produces suitable control signals to continue the sliding advance of pressure roller 30 and block 26 toward fixed roller 20. Concurrently, microcomputer 54 continuously monitors the position of cylinders 36*a*, 36*b*, 38*a*, and 38*b* and thus the position of the pressure and following rollers, and continually varies the following roller position control signal to ensure that following roller 28 continues to track pressure roller 30 as aforesaid. Microcomputer 54 similarly continually monitors the position of cylinders 46*a*, 46*b* and 48 and hence the position and angle of the knife, and varies the knife position and knife angle control signals as functions of the pressure roller position output signal to maintain the preferred spiral peel of uniform thickness. When the peeling operation is complete (completion is detected via the pressure roller position output signal, which indicates the position of pressure roller 30 relative to fixed roller 20; and, thus, the amount of material remaining on the block), following and pressure rollers 28, 30 and knife 44 are again withdrawn. As following and pressure rollers 28, 30 are withdrawn beneath fixed roller 20, the rapidly rotating block core follows the lowermost roller; namely, following roller 28. Microcomputer 54 then causes the speed of following roller drive motor 40 to change suddenly, thus assisting in ejection of the block core from lathe 10. The speed of each roller may then be further selectably varied to assist loading of a fresh block into lathe 10 by, for example, counteracting roller rotational forces which might tend to kick the fresh (non-rotating) block out of the lathe when it first contacts the rotating rollers, and by inducing roller rotational forces which tend to urge the fresh block into position between the rotating rollers so that peeling may proceed expeditiously.

Those skilled in the art will understand that the apparatus hereinbefore described may be configured either as a veneer peeling lathe (i.e. the configuration which has been described thus far) or as a "round up machine" for "rounding up" the surface of a raw log to create a block suitable for peeling in a veneer peeling lathe. Because a spindleless veneer lathe rotates the block by rotatably driving the lathe's rollers against the block, the block must be reasonably free of surface irregularities before presentation to the veneer peeling lathe, or else the rollers will not be able to properly drivingly engage the block. A round up machine is thus used to give the raw log a reasonably uniform round circumference so that it may be peeled in a spindleless lathe. The apparatus of the preferred embodiment may be configured as a round up machine merely by increasing the diameter and decreasing the roll surface area of rollers 20, 28 and 30 so that they may more easily rotate with respect to any raw log surface irregularities. When the apparatus is configured as a round up machine, the control algorithms used to program the operation of microcomputer 54 need not be capable of controlling spiral veneer peeling, but need only be capable of controlling rotational driving of the raw log by rollers 20, 28 and 30 for a short time while the knife strips away any surface irregularities so that the log is "rounded up" for subsequent presentation to apparatus which has been configured for veneer peeling.

As will be apparent to those skilled in the art, in light of the foregoing disclosure, many alterations and modifications are possible in the practice of this invention without departing from the spirit or scope thereof. Accordingly, the scope of the invention is to be construed in accordance with the substance defined by the following claims.

I claim:

1. A veneer lathe, comprising:

(a) a fixed roller;

(b) a pressure roller;

(c) a following roller;

(d) a pressure roller support which slidably carries said pressure roller;

(e) means for moving said pressure roller along said pressure roller support relative to a block positioned between said rollers;

(f) a following roller support which slidably carries said following roller;

(g) means for moving said following roller along said following roller support relative to said block;

(h) following roller positioning means for selectively positioning said following roller with respect to said fixed and pressure rollers in response to a following roller position control signal; and, (i) a knife;

whereby rotation of said rollers against said block rotates said block with respect to said knife, thereby peeling veneer from said block.

2. A veneer lathe as defined in claim 1, wherein said pressure roller is slidably positionable in a first plane, and wherein said following roller is slidably positionable into a selected location in a second plane.

3. A veneer lathe as defined in claim 1, further comprising knife positioning means for controllably advancing said knife into said rotating block in response to a knife position control signal.

4. A veneer lathe as defined in claim 1, further comprising:

(a) pressure roller position sensing means for sensing the position of said pressure roller and for producing a pressure roller position output signal representative thereof;

(b) following roller position sensing means for sensing the position of said following roller and for producing a following roller position output signal representative thereof; and, (c) signal processing means for receiving said output signals and for producing said following roller position control signal as a function of said output signals.

5. A veneer lathe as defined in claim 2, further comprising:

(a) pressure roller position sensing means for sensing the position of said pressure roller and for producing a pressure roller position output signal representative thereof;

(b) following roller position sensing means for sensing the position of said following roller and for producing a following roller position output signal representative thereof; and, (c) signal processing means for receiving said output signals and for producing said following roller position control signal as a function of said output signals.

6. A veneer lathe as defined in claim 1, further comprising knife angling means for controllably positioning said knife at a selectably variable angle with respect to said rotating block in response to a knife angle control signal.

7. A veneer lathe as defined in claim 2, further comprising knife angling means for controllably positioning said knife at a selectably variable angle with respect to said rotating block in response to a knife angle control signal.

8. A veneer lathe as defined in claim 4, further comprising knife angling means for controllably positioning said knife at a selectably variable angle with respect to said rotating block in response to a knife angle control signal.

9. A veneer lathe as defined in claim 5, further comprising knife angling means for controllably positioning said knife at a selectably variable angle with respect to said rotating block in response to a knife angle control signal.

10. A veneer lathe as defined in claim 1, further comprising:

(a) fixed roller drive means for rotatably driving said fixed roller;

(b) pressure roller drive means for rotatably driving said pressure roller; and, (c) following roller drive means for rotatably driving said following roller;

whereby said fixed roller may be rotated at a first speed, said pressure roller may be rotated at a second speed and said following roller may be rotated at a third speed.

11. A veneer lathe as defined in claim 2, further comprising:

(a) fixed roller drive means for rotatably driving said fixed roller;

(b) pressure roller drive means for rotatably driving said pressure roller; and, (c) following roller drive means for rotatably driving said following roller;

whereby said fixed roller may be rotated at a first speed, said pressure roller may be rotated at a second speed and said following roller may be rotated at a third speed.

12. A veneer lathe as defined in claim 4, further comprising:

(a) fixed roller drive means for rotatably driving said fixed roller;

(b) pressure roller drive means for rotatably driving said pressure roller; and, (c) following roller drive means for rotatably driving said following roller;

whereby said fixed roller may be rotated at a first speed, said pressure roller may be rotated at a second speed and said following roller may be rotated at a third speed.

13. A veneer lathe as defined in claim 5, further comprising:

(a) fixed roller drive means for rotatably driving said fixed roller;

(b) pressure roller drive means for rotatably driving said pressure roller; and, (c) following roller drive means for rotatably driving said following roller;

whereby said fixed roller may be rotated at a first speed, said pressure roller may be rotated at a second speed and said following roller may be rotated at a third speed.

14. A veneer lathe as defined in claim 4, further comprising knife positioning means for controllably advancing said knife into said rotating block in response to a knife position control signal and wherein said signal processing means is further for producing said knife position control signal as a function of said pressure roller position output signal.

15. A veneer lathe as defined in claim 4, further comprising knife angling means for controllably positioning said knife at a selectably variable angle with respect to said rotating block in response to a knife angle control signal and wherein said signal processing means is further for producing said knife angle control signal as a function of said pressure roller position output signal.

16. A veneer lathe as defined in claim 5, further comprising knife positioning means for controllably advancing said knife into said rotating block in response to a knife position control signal and wherein said signal processing means is further for producing said knife position control signal as a function of said pressure roller position output signal.

17. A veneer lathe as defined in claim 5, further comprising knife angling means for controllably positioning said knife at a selectably variable angle with respect to said rotating block in response to a knife angle control signal and wherein said signal processing means is further for producing said knife angle control signal as a function of said pressure roller position output signal.

18. A veneer lathe as defined in claim 14, wherein said signal processing means is further for receiving one or more user-supplied parameters representative of a desired operating condition of said veneer lathe and for altering said following roller position control signal, said knife position control signal, or said knife angle control signal in response thereto to cause said veneer lathe to assume said desired operating condition.

19. A veneer lathe as defined in claim 15, wherein said signal processing means is further for receiving one or more user-supplied parameters representative of a desired operating condition of said veneer lathe and for altering said following roller position control signal, said knife position control signal, or said knife angle control signal in response thereto to cause said veneer lathe to assume said desired operating condition.

20. A veneer lathe as defined in claim 16, wherein said signal processing means is further for receiving one or more user-supplied parameters representative of a desired operating condition of said veneer lathe and for altering said following roller position control signal, said knife position control signal, or said knife angle control signal in response thereto to cause said veneer lathe to assume said desired operating condition.

21. A veneer lathe as defined in claim 17, wherein said signal processing means is further for receiving one or more user-supplied parameters representative of a desired operating condition of said veneer lathe and for altering said following roller position control signal, said knife position control signal, or said knife angle control signal in response thereto to cause said veneer lathe to assume said desired operating condition.

* * * * *